US009410288B2

(12) United States Patent
Castro et al.

(10) Patent No.: US 9,410,288 B2
(45) **Date of Patent: *Aug. 9, 2016**

(54) USE OF NANOCRYSTALINE CELLULOSE AND POLYMER GRAFTED NANOCRYSTALINE CELLULOSE FOR INCREASING RETENTION IN PAPERMAKING PROCESS

(71) Applicant: Ecolab USA Inc., Naperville, IL (US)

(72) Inventors: David A. Castro, DeKalb, IL (US); Rangarani Karnati, Naperville, IL (US); Shawnee M. Wilson, Downers Grove, IL (US); Weiguo Cheng, Naperville, IL (US); Mei Liu, Plainfield, IL (US); Zhiyi Zhang, Naperville, IL (US)

(73) Assignee: ECOLAB USA INC., Naperville, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/962,556

(22) Filed: Aug. 8, 2013

(65) Prior Publication Data

US 2015/0041088 A1 Feb. 12, 2015

(51) Int. Cl.

| | |
|---|---|
| ***D21H 17/37*** | (2006.01) |
| ***D21H 19/00*** | (2006.01) |
| ***D21H 21/18*** | (2006.01) |
| ***D21H 21/20*** | (2006.01) |
| ***D21H 23/22*** | (2006.01) |
| ***D21H 17/53*** | (2006.01) |
| ***D21H 11/18*** | (2006.01) |
| ***D21H 17/36*** | (2006.01) |

(52) U.S. Cl.

CPC ..... *D21H 17/53* (2013.01); *D21H 11/18* (2013.01); *D21H 17/36* (2013.01); *D21H 17/37* (2013.01); *D21H 17/375* (2013.01); *D21H 21/18* (2013.01); *D21H 21/20* (2013.01); *D21H 23/22* (2013.01)

(58) Field of Classification Search

USPC ..... 162/158, 164.1–164.7, 168.1–168.3, 162/168.7, 184, 175–178; 524/9, 13, 524/35–46; 435/277; 977/895–897

See application file for complete search history.

(56) References Cited

U.S. PATENT DOCUMENTS

| | | | | |
|---|---|---|---|---|
| 2,178,139 | A | 10/1939 | Epstein et al. | |
| 2,202,601 | A | 5/1940 | Ried | |
| 3,793,299 | A * | 2/1974 | Zimmerer | 521/30 |
| 4,385,961 | A | 5/1983 | Svending et al. | |
| 4,388,150 | A | 6/1983 | Sunden et al. | |
| 4,753,710 | A | 6/1988 | Langley et al. | |
| 4,783,314 | A | 11/1988 | Hoots et al. | |
| 4,913,775 | A | 4/1990 | Langley et al. | |
| 4,966,652 | A | 10/1990 | Wasser | |
| 4,992,380 | A | 2/1991 | Moriarty et al. | |
| 5,098,520 | A | 3/1992 | Begala | |
| 5,167,776 | A | 12/1992 | Bhaskar et al. | |
| 5,171,450 | A | 12/1992 | Hoots | |
| 5,182,062 | A | 1/1993 | Lee et al. | |
| 5,254,221 | A | 10/1993 | Lowry et al. | |
| 5,274,055 | A | 12/1993 | Honig et al. | |
| 5,346,589 | A | 9/1994 | Braunstein et al. | |
| 5,840,158 | A | 11/1998 | Choo et al. | |
| 6,071,379 | A | 6/2000 | Wong Shing et al. | |
| 6,361,652 | B2 | 3/2002 | Keiser et al. | |
| 6,361,653 | B2 | 3/2002 | Keiser et al. | |
| 6,372,805 | B1 | 4/2002 | Keiser et al. | |
| 6,379,753 | B1 * | 4/2002 | Soane et al. | 427/434.2 |
| 6,486,216 | B1 | 11/2002 | Keiser et al. | |
| 6,592,718 | B1 | 7/2003 | Wong Shing et al. | |
| 6,605,674 | B1 | 8/2003 | Whipple et al. | |
| 7,125,469 | B2 | 10/2006 | Barcus et al. | |
| 7,473,334 | B2 | 1/2009 | Wong Shing et al. | |
| 7,497,924 | B2 * | 3/2009 | Nguyen et al. | 162/157.6 |
| 7,615,135 | B2 | 11/2009 | Harrington et al. | |
| 7,641,776 | B2 | 1/2010 | Nagar et al. | |
| 7,829,738 | B1 | 11/2010 | Brammer, Jr. et al. | |
| 7,955,504 | B1 * | 6/2011 | Jovanovic et al. | 210/321.71 |
| 8,012,758 | B2 | 9/2011 | Enzien et al. | |
| 8,021,518 | B2 | 9/2011 | Furman et al. | |
| 8,066,847 | B2 | 11/2011 | Grigoriev et al. | |
| 8,067,629 | B2 | 11/2011 | Tong | |
| 8,071,667 | B2 | 12/2011 | Furman, Jr. et al. | |
| 8,082,649 | B2 | 12/2011 | Rider | |
| 8,088,213 | B2 | 1/2012 | Cheng et al. | |
| 8,092,618 | B2 | 1/2012 | Sharpe et al. | |
| 8,092,649 | B2 | 1/2012 | Shevchenko et al. | |
| 8,097,687 | B2 | 1/2012 | Kurian et al. | |

(Continued)

FOREIGN PATENT DOCUMENTS

| | | |
|---|---|---|
| WO | 2010124378 | 11/2010 |
| WO | 2010124378 A1 | 11/2010 |

(Continued)

OTHER PUBLICATIONS

J. Peel, Paper Science & Paper Manufacture 1999, p. 90.*

(Continued)

*Primary Examiner* — Dennis Cordray

(74) *Attorney, Agent, or Firm* — Eric D. Babych; Brinks Gilson & Lione

(57) ABSTRACT

The invention provides methods and compositions for improving the characteristics of paper substrates. The method involves adding to a paper substrate an NCC-polymer. NCC-polymers have unique chemical properties which result in improvements in wet strength, dry strength and drainage retention properties of the paper substrates.

8 Claims, 1 Drawing Sheet

(56) References Cited

U.S. PATENT DOCUMENTS

| | | | |
|---|---|---|---|
| 8,101,045 | B2 | 1/2012 | Furman et al. |
| 8,123,042 | B2 | 2/2012 | Tran |
| 8,172,983 | B2 | 5/2012 | Cheng et al. |
| 8,242,287 | B2 | 8/2012 | Schertzer et al. |
| 8,246,780 | B2 | 8/2012 | Duggirala et al. |
| 8,247,593 | B2 | 8/2012 | Morrison et al. |
| 8,247,597 | B2 | 8/2012 | Fair et al. |
| 8,258,208 | B2 | 9/2012 | Kurian et al. |
| 8,262,852 | B2 | 9/2012 | Duggirala et al. |
| 8,262,858 | B2 | 9/2012 | Duggirala et al. |
| 8,288,835 | B2 | 10/2012 | Quevy et al. |
| 8,298,439 | B2 | 10/2012 | Blubaugh et al. |
| 8,298,508 | B2 | 10/2012 | Wang et al. |
| 8,302,778 | B2 | 11/2012 | Tran |
| 8,366,877 | B2 | 2/2013 | Duggirala et al. |
| 8,382,947 | B2 | 2/2013 | Skaggs et al. |
| 8,382,950 | B2 | 2/2013 | Cheng |
| 8,398,901 | B2 | 3/2013 | Beck et al. |
| 8,414,739 | B2 | 4/2013 | Kimura et al. |
| 8,440,052 | B2 | 5/2013 | Duggirala et al. |
| 8,444,812 | B2 | 5/2013 | Grigoriev et al. |
| 8,465,623 | B2 | 6/2013 | Zhao et al. |
| 2005/0025659 | A1 | 2/2005 | Godfrey et al. |
| 2011/0182990 | A1 | 7/2011 | Su |
| 2011/0196094 | A1 | 8/2011 | Hamad et al. |
| 2011/0250341 | A1 | 10/2011 | Keiser et al. |
| 2011/0277947 | A1 | 11/2011 | Hua et al. |
| 2011/0293932 | A1 | 12/2011 | Jiang et al. |
| 2013/0139856 | A1 | 6/2013 | Vinson et al. |
| 2013/0146099 | A1 | 6/2013 | Monsrud et al. |
| 2013/0146102 | A1 | 6/2013 | Monsrud et al. |
| 2013/0146425 | A1 | 6/2013 | Tokhtuev |
| 2014/0083416 | A1* | 3/2014 | Nuopponen et al. ..... 127/29 |

FOREIGN PATENT DOCUMENTS

| | | | |
|---|---|---|---|
| WO | 2010125247 | | 11/2010 |
| WO | 2010125247 | A2 | 11/2010 |
| WO | 2010134868 | | 11/2010 |
| WO | 2010134868 | A1 | 11/2010 |
| WO | 2012034997 | | 3/2012 |
| WO | 2012034997 | A1 | 3/2012 |

OTHER PUBLICATIONS

Smook, Gary A., Handbook for Pulp and Paper Technologists, 2nd ed, Angus Wilde Publications, 1992, p. 283.*

International Search Report, PCT/US2014/049614, documents considered to be relevant, mailed Nov. 18, 2014.

* cited by examiner

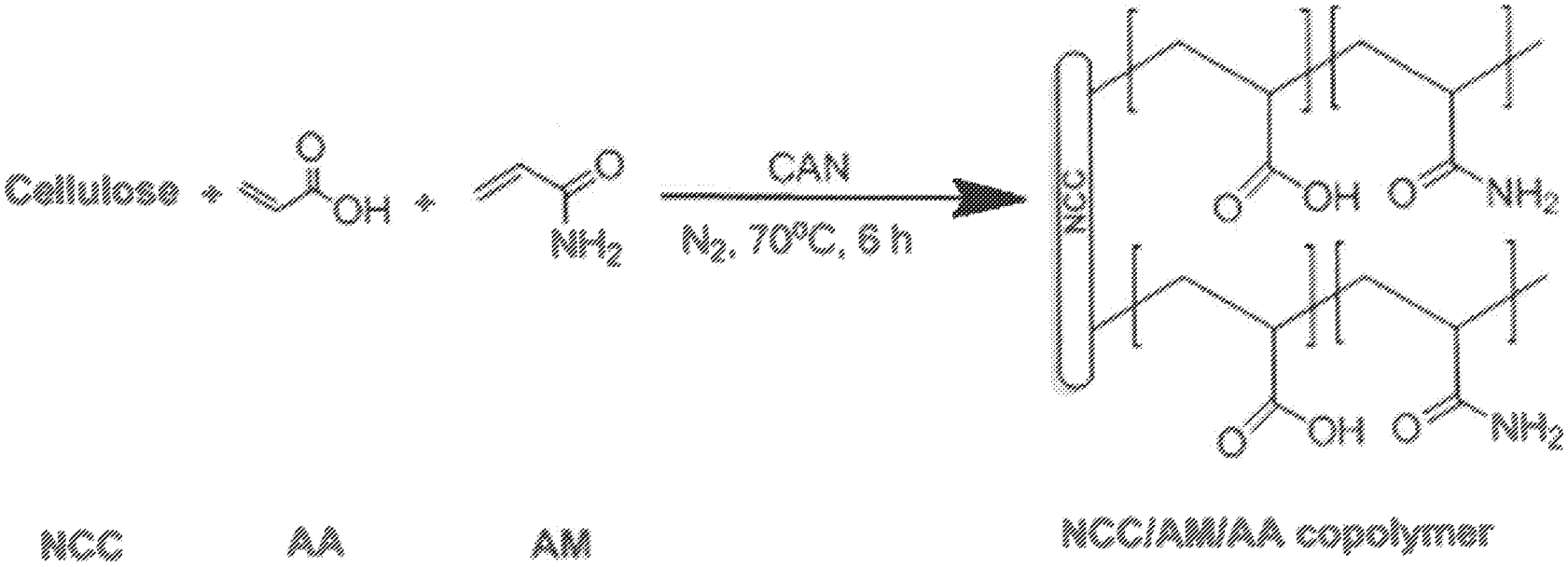
Cellulose
+
+
CAN
$N_2$, 70°C, 6 h
NCC
AA
AM
NCC/AM/AA copolymer

USE OF NANOCRYSTALINE CELLULOSE AND POLYMER GRAFTED NANOCRYSTALINE CELLULOSE FOR INCREASING RETENTION IN PAPERMAKING PROCESS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The invention relates to compositions, methods, and apparatuses for improving drainage retention, wet strength, and dry strength of paper in a papermaking process. A typical papermaking process includes the steps of: 1) pulping wood or some other source of papermaking fibers; 2) producing a paper mat from the pulp, the paper mat being an aqueous slurry of cellulosic fiber which may also contain additives such as inorganic mineral fillers or pigments; 3) depositing this slurry on a moving papermaking wire or fabric; 4) forming a sheet from the solid components of the slurry by draining the water; 5) pressing and drying the sheet to further remove water, and 6) potentially rewetting the dry sheet by passing it through a size press and further drying it to form a paper product.

When conducting a papermaking process, a number of concerns need to be taken into account to assure the quality of the resulting paper product. For example when draining water from the slurry, as many fibers and chemical additives should be retained and not flow out with the water. Similarly the resulting sheet should have adequate wet strength and dry strength.

As described for example in in U.S. Pat. Nos. 7,473,334, 6,605,674, 6,071,379, 5,254,221, 6,592,718, 5,167,776 and 5,274,055 a number of retention aids such as polymers flocculants, and silica based microparticles, may be added to the slurry to facilitate drainage retention. The retention aids function to retain solid matter within the slurry as water is drained out of the slurry. In addition to retaining fibers, the retention aid should also retain additives such as optical brighteners, fillers, and strength agents. The selection of such retention aids is complicated by the fact that they must both allow for the free drainage of water from the slurry and also must not interfere with or otherwise degrade the effectiveness of other additives present in the resulting paper product.

As described for example in U.S. Pat. Nos. 8,465,623, 7,125,469, 7,615,135 and 7,641,776 a number of materials function as effective dry strength agents. These agents can be added to the slurry to increase the strength properties of the resulting sheet. As with retention aids however they must both allow for the free drainage of water from the slurry and also must not interfere with or otherwise degrade the effectiveness of other additives present in the resulting paper product.

As described for example in U.S. Pat. Nos. 8,414,739 and 8,382,947, surface strength agents are materials which increase the resistance of the resulting paper product to abrasive forces. Surface strength agents are often applied as coatings over the formed paper sheet at the size press. Of particular importance is that such agents be compatible with other items present in coatings such as sizing agents and optical brightening agents. In addition desirable surface strength agents must not unduly impair the flexibility of the resulting paper product.

As it is difficult to increase dry strength, surface strength, and/or drainage retention while simultaneously not inhibiting other attributes of the paper or additives therein, there is an ongoing need for improved methods of improving dry strength, surface strength, and/or drainage retention. The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 CFR §1.56(a) exists.

BRIEF SUMMARY OF THE INVENTION

To satisfy the long-felt but unsolved needs identified above, at least one embodiment of the invention is directed towards a method of improving a paper substrate used in a papermaking process. The method comprising the steps of: providing an NCC-polymer, and adding the NCC-polymer to a paper substrate in the dry end of a papermaking process, wherein the NCC-polymer is substantially distributed on the surface of the substrate. The NCC-polymer may be distributed with the use of a size press.

The NCC-polymer may comprises a polymer chain bonded to an NCC core and the polymer chain made up of one or more monomers selected from the list consisting of: vinyl acetate, acrylic acid, sodium acrylate, ammonium acrylate, methyl acrylate, acrylamide, acrylonitrile, N,N-dimethyl acrylamide, 2-acrylamido-2-methylpropane-1-sulfonic acid, sodium 2-acrylamido-2-methylpropane-1-sulfonate, 3-acrylamidopropyl-trimethyl-ammonium chloride, diallyldimethylammonium chloride, 2-(dimethylamino)ethyl acrylate, 2-(acryloyloxy)-N,N,N-trimethylethanaminium chloride, N,N-dimethylaminoethyl acrylate benzyl chloride quaternary salt, 2-(acryloyloxy)-N,N,N-trimethylethanamninium methyl sulfate, 2-(dimethylamino)ethyl methacrylate, 2-(methacryloyloxy)-N,N,N-trimethylethanaminium chloride, 3-(dimethylamino)propyl methacrylamide, 2-(methacryloyloxy)-N,N,N-trimethylethanaminium methyl sulfate, methacrylic acid, methacrylic anhydride, methyl methacrylate, methacryloyloxy ethyl trimethyl ammonium chloride, 3-methacrylamidopropyl-trimethyl-ammonium chloride, hexadecyl methacrylate, octadecyl methacrylate, docosyl acrylate, n-vinyl pyrrolidone, 2-vinyl pyridine, 4-vinyl pyridine, epichlorohydrin, n-vinyl formamide, n-vinyl acetamide, 2-hydroxyethyl acrylate glycidyl methacrylate, 3-(allyloxy)-2-hydroxypropane-1-sulfonate, 2-(allyloxy)ethanol, ethylene oxide, propylene oxide, 2,3-epoxypropyltrimethylammonium chloride, (3-glycidoxypropyl)trimethoxy silane, epichlorohydrin-dimethylamine, vinyl sulfonic acid sodium salt, sodium 4-styrene sulfonate, caprolactam and any combination thereof.

The NCC-polymer may be a polymer grafted on to at least one NCC core. The NCC-polymer may be a branched polymer having a first polymer chain extending from an NCC core and at least one branch diverting away from the first polymer chain. The branch may be constructed out of a different selection of monomers than the first polymer chain, the different selection being different in monomer type, monomer ratio, or both. The NCC-polymer may increase the dry strength of the paper substrate.

Additional features and advantages are described herein, and will be apparent from, the following Detailed Description.

BRIEF DESCRIPTION OF THE DRAWINGS

A detailed description of the invention is hereafter described with specific reference being made to the drawings in which:

FIG. 1 is an illustration of a reaction forming an NCC/AM/AA polyelectrolyte copolymer.

For the purposes of this disclosure, like reference numerals in the figures shall refer to like features unless otherwise indicated. The drawings are only an exemplification of the principles of the invention and are not intended to limit the invention to the particular embodiments illustrated.

DETAILED DESCRIPTION OF THE INVENTION

The following definitions are provided to determine how terms used in this application, and in particular how the claims, are to be construed. The organization of the definitions is for convenience only and is not intended to limit any of the definitions to any particular category.

"Wet End" means that portion of the papermaking process prior to a press section where a liquid medium such as water typically comprises more than 45% of the mass of the substrate, additives added in a wet end typically penetrate and distribute within the slurry.

"Dry End" means that portion of the papermaking process including and subsequent to a press section where a liquid medium such as water typically comprises less than 45% of the mass of the substrate, dry end includes but is not limited to the size press portion of a papermaking process, additives added in a dry end typically remain in a distinct coating layer outside of the slurry.

"Consisting Essentially of" means that the methods and compositions may include additional steps, components, ingredients or the like, but only if the additional steps, components and/or ingredients do not materially alter the basic and novel characteristics of the claimed methods and compositions.

"Flocculant" means a composition of matter which when added to a liquid carrier phase within which certain particles are thermodynamically inclined to disperse, induces agglomerations of those particles to form as a result of weak physical forces such as surface tension and adsorption, flocculation often involves the formation of discrete globules of particles aggregated together with films of liquid carrier interposed between the aggregated globules, as used herein flocculation includes those descriptions recited in ASTME 20-85 as well as those recited in Kirk-Othmer Encyclopedia of Chemical Technology, 5th Edition, (2005), (Published by Wiley, John & Sons, Inc.).

"Surface Strength" means the tendency of a paper substrate to resist damage due to abrasive force.

"Dry Strength" means the tendency of a paper substrate to resist damage due to shear force(s), it includes but is not limited to surface strength.

"Wet Strength" means the tendency of a paper substrate to resist damage due to shear force(s) when rewet.

"Wet Web Strength" means the tendency of a paper substrate to resist shear force(s) while the substrate is still wet.

"Substrate" means a mass containing paper fibers going through or having gone through a papermaking process, substrates include wet web, paper mat, slurry, paper sheet, and paper products.

"Paper Product" means the end product of a papermaking process it includes but is not limited to writing paper, printer paper, tissue paper, cardboard, paperboard, and packaging paper.

"NCC" or "NCC Core" means nano-crystalline cellulose. NCC Core is a discrete mass of NCC crystal onto which polymers may be grafted. an NCC or NCC core may or may not have been formed by acid hydrolysis of cellulose fibers and NCC or NCC core may or may not have been modified by this hydrolysis to have functional groups appended thereto including but not limited to sulfate esters.

"NCC-Polymer" means a composition of matter comprising at least an NCC core with at least one polymer chain extending therefrom.

"NCC Coupling" means a composition of matter comprising at least two NCC cores, the coupling can be a polymer linkage in which at least in part a polymer chain connects the two NCC cores, or it can be an NCC twin in which two (or more) NCC cores are directly connected to each other by a sub polymer linkage (such as epoxide) and/or direct bonding of one or more of the NCC cores' atoms.

"Consisting Essentially of" means that the methods and compositions may include additional steps, components, ingredients or the like, but only if the additional steps, components and/or ingredients do not materially alter the basic and novel characteristics of the claimed methods and compositions.

"Slurry" means a mixture comprising a liquid medium such as water within which solids such as fibers (such as cellulose fibers) and optionally fillers are dispersed or suspended such that between >99% to 45% by mass of the slurry is liquid medium.

"Surfactant" is a broad term which includes anionic, nonionic, cationic, and zwitterionic surfactants. Enabling descriptions of surfactants are stated in Kirk-Othmer, *Encyclopedia of Chemical Technology*, Third Edition, volume 8, pages 900-912, and in *McCutcheon's Emulsifiers and Detergents*, both of which are incorporated herein by reference.

"Size Press" means the part of the papermaking machine where the dry paper is rewet by applying a water-based formulation containing surface additives such as starch, sizing agents and optical brightening agents, a more detailed descriptions of size press is described in the reference *Handbook for Pulp and Paper Technologists,* 3rd Edition, by Gary A. Smook, Angus Wilde Publications Inc., (2002).

In the event that the above definitions or a description stated elsewhere in this application is inconsistent with a meaning (explicit or implicit) which is commonly used, in a dictionary, or stated in a source incorporated by reference into this application, the application and the claim terms in particular are understood to be construed according to the definition or description in this application, and not according to the common definition, dictionary definition, or the definition that was incorporated by reference. In light of the above, in the event that a term can only be understood if it is construed by a dictionary, if the term is defined by the Kirk-Othmer Encyclopedia of Chemical Technology, 5th Edition, (2005), (Published by Wiley, John & Sons, Inc.) this definition shall control how the term is to be defined in the claims.

At least one embodiment of the invention is directed towards adding at least one NCC-Polymer to a paper substrate in a papermaking process. The NCC-Polymer may be added in the wet end and/or in the dry end. The NCC-Polymer may be added as a coating outside of the substrate or may be dispersed within the substrate. A coating may partially or fully enclose the substrate. The NCC-Polymer may comprise linear, branched, cyclic, polymers extending from the NCC core and/or may be an NCC Graft Polymer.

As described in US Published Patent Applications 2011/0293932, 2011/0182990, 2011/0196094, and U.S. Pat. No. 8,398,901, NCC are naturally occurring crystals present in plant fibers. A typical cellulose bearing fiber comprises regions of amorphous cellulose and regions of crystalline cellulose. NCC can be obtained by separating the crystalline cellulose regions from the amorphous cellulose regions of a plant fiber. Because their compact nature makes crystalline cellulose regions highly resistant to acid hydrolysis, NCC is often obtained by acid hydrolyzing plant fibers. NCC crystallites may have 5-10 nm diameter and 100-500 nm length. NCC may have a crystalline fraction of no less than 80% and often between 85% and 97%.

NCC is an extremely strong material but its use as an additive in paper products is constrained because of its small size. As stated in US Published Patent Application 2011/0277947 å [0019], because NCC is an extremely short subset of a fiber, it does not have sufficient length to impart strength aiding qualities to the long stretches of paper fibers.

In at least one embodiment the composition added to a papermaking substrate comprises an NCC core with at least one polymer chain extending from the NCC core. NCC comprises a number of hydroxyl groups which are possible anchor sites from which polymer chains may extend. Without being limited by a particular theory or design of the invention or of the scope afforded in construing the claims, it is believed that because of its unique aspect ratio, density, anchor sites, rigidity and supporting strength, NCC-Polymers are able to arrange polymer chains in unique arrangements that afford a number of unique properties that enhance paper characteristics.

In at least one embodiment the NCC-Polymer is added in the wet end of a papermaking process. In at least one embodiment the NCC-Polymer is added as a coating in the size press of a papermaking process. Detailed descriptions of the wet and dry ends of a papermaking process and addition points for chemical additives therein are described in the reference *Handbook for Pulp and Paper Technologists, 3rd Edition*, by Gary A. Smook, Angus Wilde Publications Inc., (2002). The NCC-Polymer may be added to the papermaking process at any addition point(s) described therein for any other chemical additive and according to the methods and with any of the apparatuses also described therein.

In at least one embodiment the NCC-Polymer is formed by the derivatization of one or more hydroxyl groups on an NCC crystal through condensation polymerization or grafting of vinyl monomers via radical polymerization to meet desired end user requirements.

In at least one embodiment the polymer attached to the NCC core is a polysaccharide. In at least one embodiment the polysaccharide NCC-Polymer is used as viscosity modifier in enhanced oil recovery, as flocculants for wastewater treatment and filler strength agent in a papermaking process.

In at least one embodiment the polymer attached to the NCC core is a vinyl polymer. In at least one embodiment it is a copolymer having structural units of at least two vinyl monomers including but not limited to acrylamide and acrylic acid. Polyacrylamide, polyacrylic acid, and 2-(methacryloyloxy)ethyl trimethylammonium chloride are efficient flocculants for water treatment and various applications. However, vinyl polymers show limited biodegradability and poor shear stability whereas nanocrystalline cellulose (NCC) is shear stable but are less efficient as flocculants. Connecting non-ionic, anionic, and/or cationic vinyl monomers on an NCC core yields better performing polyelectrolyte flocculants, and filler materials.

In at least one embodiment the NCC-polymer is added to the papermaking process alongside 2-(methacryloyloxy) ethyl trimethylammonium chloride. In at least one embodiment the NCC-polymer added to a papermaking process is exposed to shear in excess to what a non-NCC-polymer can endure and still function, and continues to function.

In at least one embodiment the NCC-polymer is a branched polymer in which from a first chain of polymer structural units extending from the NCC core, one or more distinct other chains branch off from the first polymer chain and/or from other distinct chain branches. In at least one embodiment the first chain is comprised of a different variety of monomer units than one or more of the branch chains. Differences in chain compositions allows for versatile polymer arrangements as a means of imparting a variety of functional groups to a polymer. It also permits one to combine the best properties of two or more polymers in one physical unit. For example the first chain may be selected for its capacity to support or position functionally active polymer branches according to a geometry which has superior effects.

In at least one embodiment the polymer chain/branch is grown according to one or more of: a grow-to method, a grow-from method, and/or a grow-through method. In the grow-to approach an end group of a pre-formed polymer is coupled with a functional group on the NCC core. In the growing-from approach, the growth of the polymer chain occurs from initiation sites attached to the NCC core. In the growing-through approach a vinyl macro-monomer of cellulose is copolymerized from the NCC core with low molecular weight co-monomer.

Representative examples of vinyl monomers which can be used for any of the three growth approaches include but are not limited to vinyl acetate, acrylic acid, sodium acrylate, ammonium acrylate, methyl acrylate, acrylamide, acrylonitrile, N,N-dimethyl acrylamide, 2-acrylamido-2-methylpropane-1-sulfonic acid, sodium 2-acrylamido-2-methylpropane-1-sulfonate, 3-acrylamidopropyl-trimethyl-ammonium chloride, diallyldimethylammonium chloride, 2-(dimethylamino)ethyl acrylate, 2-(acryloyloxy)-N,N,N-trimethylethanaminium chloride, N,N-dimethylaminoethyl acrylate benzyl chloride quaternary salt, 2-(acryloyloxy)-N,N,N-trimethylethanaminium methyl sulfate, 2-(dimethylamino) ethyl methacrylate, 2-(methacryloyloxy)-N,N,N-trimethylethanaminium chloride, 2-(methacryloyloxy)-N,N,N-trimethylethanaminium methyl sulfate, 3-(dimethylamino) propyl methacrylamide, methacrylic acid, methacrylic anhydride methyl methacrylate, methacryloyloxy ethyl trimethyl ammonium chloride, 3-methacrylamidopropyl-trimethyl-ammonium chloride, hexadecyl methacrylate, octadecyl methacrylate, docosyl acrylate, n-vinyl pyrrolidone, 2-vinyl pyridine, 4-vinyl pyridine, epichlorohydrin, n-vinyl formamide, n-vinyl acetamide, 2-hydroxyethyl acrylate glycidyl methacrylate, 3-(allyloxy)-2-hydroxypropane-1-sulfonate, 2-(allyloxy)ethanol, ethylene oxide, propylene oxide, 2,3-epoxypropyltrimethylammonium chloride, (3-glycidoxypropyl)trimethoxy silane, epichlorohydrin-dimethylamine, vinyl sulfonic acid sodium salt, Sodium 4-styrene sulfonate, caprolactam and any combination thereof.

In at least one embodiment addition of an NCC-polymer to a papermaking furnish or slurry improves drainage retention. As shown in the Examples, NCC-polymers used alongside starch, a cationic flocculant and an acrylic acid polymer have superior retention performance to such drainage programs lacking the NCC-polymers. Improved retention of fines, fillers, and other components of the furnish decreases the amount of such components lost to the whitewater and hence reduces the amount of material wastes, the cost of waste disposal and the adverse environmental effects. It is generally desirable to reduce the amount of material employed in a papermaking process.

In at least one embodiment adding NCC-polymer to a papermaking furnish or slurry improves wet strength. As described in U.S. Pat. No. 8,172,983, a high degree of wet strength in paper is desired to allow for the addition of more filler (such as PCC or GCC) to the paper. Increasing filler content results in superior optical properties and cost savings (filler is cheaper than fiber).

In at least one embodiment the NCC-polymer is added as a coating or as part of a coating during size press of a papermaking process. The NCC-polymer may be added as a coating applied during a size press operation and may be added alongside starch, sizing agents or any other additive added during the size press.

In at least one embodiment the NCC-polymer added to the papermaking process is an NCC graft polymer. The graft polymer comprises two or more NCC cores. The NCC graft polymer may include a single polymer chain bridging between the NCC cores. The NCC Graft may also include two or more NCC cores with distinct polymer chains that are cross-linked to each other. As such a NCC-polymer is cross-linked to at least one other NCC-polymer where the cross-linkage is located at one of the structural units of the polymer and not at the NCC core. The cross linkage may be achieved by one or more polymer cross-linking agents known in the art. The NCC graft polymer may be in the form of a hydrogel as described in US Published Patent Application 2011/0182990.

In at least one embodiment a composition is added to a commercial process. The composition is a mixture comprising: a) NCC mixed with a polymer additive that is not an NCC-polymer, b) NCC mixed with a polymer additive that is an NCC-polymer, and/or c) a polymer additive which is an NCC-Polymer. In at least one embodiment the polymer additive is a polymer made up of one or more of NCC, non-ionic, water-soluble monomers, anionic monomers, cationic monomers, and any combination thereof. The polymer additives may be manufactured according any process described in the references: *Emulsion Polymerization and Emulsion Polymers*, by Peter A. Lovell et al, John Wiley and Sons, (1997), *Principles of polymerization*, Fourth Edition, by George Odian, John Wiley and Sons, (2004), *Handbook of RAFT Polymerization*, by Christopher Barner-Kowollik, Wiley-VCH, (2008), *Handbook of Radical Polymerization*, by Krzysztof Matyjaszewski et al, John Wiley and Sons, (2002), *Controlled/Living Radical Polymerization: Progress in ATRP, NMP, and RAFT*: by K. Matyjaszewski, Oxford University Press (2000), and *Progress in Controlled Radical Polymerization: Mechanisms and Techniques*, by Krzysztof Matyjaszewski et al, ACS Symposium Series 1023 (2009). The polymer additives may be manufactured according any process including but not limited to Solution, emulsion, inverse-emulsion, dispersion, atom transfer radical polymerization (ATRP), Reversible addition-fragmentation-chain transfer polymerization (RAFT), and ring opening polymerization.

The polymer additive may be added to any known chemical feed point in any of commercial process such as:

- Industrial wastewater treatment including: solids liquids separations in clarification, dissolved air flotation, induced air flotation, dewatering, and raw water treatment,
- Oil separation applications. Filtration aids, metals removal.
- Paper, paperboard, tissue, and pulp manufacture including: manufacture process improvement, fine particle retention and dewatering, coatings and surface treatments, functional additives
- Cooling water treatment including: Calcium Carbonate inhibitor, Calcium phosphate inhibitor, Zinc phosphate stabilizer, Iron and/or silt dispersant, Biodispersant, Silica scale inhibitor, Scale inhibitor for other species (e.g. Calcium Fluoride, Calcium sulfate, etc etc), Dual corrosion and scale inhibitor
- Oil well treatment fluids and their application including: Drilling fluids and operations, Cement and cementing operations, Completion fluids and operations, Stimulation fluids (Acidizing and Fracturing) and operations, Water conformance chemistries and applications, Also Enhanced Oil Recovery (EOR) chemistries and operation
- Industrial warewash applications including: Reduction in hardness of wash water; Prevention of hard water film accumulation; Inhibition of corrosion of metal wares; Soil removal from wares; Prevention of soil redeposition
- Industrial laundry applications including: Reduction in hardness of wash water; Prevention of hard water film accumulation; Prevention of hard water encrustation of fabrics; Dewatering of fabric; Soil release from fabric; Prevention of soil accumulation on fabrics; Prevention of soil redeposition in wash; Color retention of fabrics; Prevention of dye transfer in wash; Delivery of softening agents to fabrics; Delivery of antimicrobial agents to fabrics; Delivery of fragrance to fabric
- Healthcare applications including: Inhibition of corrosion of metal instruments during cleaning/processing
- Mining and Mineral Processing including: Process additives applied in the mining or transporting of a mineral substrate, in any mineral beneficiation process or related waste treatment process. Mining and mineral processing includes but not limited to: alumina, coal, copper, precious metals and sand and gravel. Applications covered includes but not limited to: solid liquid separations, flotation, scale control, dust control, metals removal and crystal growth modifiers
- Silica Materials and Process applications including: Binder for strength improvement, Slip and investment casting, Catalysts industry (template), Refractories, Abrasion and polishing, Antifoam, Printing (inkjet/offset), Drainage aids.

Any commercial process described in one or more of: U.S. patent application Ser. Nos. 13/416,272 and 13/730,087, US Published Patent Application 2005/0025659, 2011/0250341 A1, 2013/0146099, 2013/0146102 2013/0146425, 2013/0139856, and/or U.S. Pat. Nos. 2,202,601, 2,178,139, 8,465,623, 4,783,314, 4,992,380, 5,171,450, 6,486,216, 6,361,653, 5,840,158, 6,361,652, 6,372,805, 4,753,710, 4,913,775, 4,388,150, 4,385,961, 5,182,062, 5,098,520, 7,829,738, 8,262,858, 8,012,758, 8,288,835, 8,021,518, 8,298,439, 8,067,629, 8,298,508, 8,066,847, 8,298,439, 8,071,667, 8,302,778, 8,088,213, 8,366,877, 8,101,045, 8,382,950, 8,092,618, 8,440,052, 8,097,687, 8,444,812, 8,092,649, 8,465,623, 8,082,649, 8,101,045, 8,123,042, 8,242,287, 8,246,780, 8,247,593, 8,247,597, 8,258,208, and/or 8,262,852.

Representative non-ionic, water-soluble monomers suitable for use in the polymer additive include one or more of: acrylamide, methacrylamide, N,N-dimethylacrylamide, N,N-diethylacrylamide, N-isopropylacrylamide, N-vinylformamide, N-vinylmethylacetamide, N-vinyl pyrrolidone, 2-vinyl pyridine, 4-vinyl pyridine, epichlorohydrin, acrylonitrile, hydroxyethyl methacrylate, hydroxyethyl acrylate, hydroxypropyl acrylate, hydroxypropyl methacrylate, hexadecyl methacrylate, octadecyl methacrylate, glycidyl methacrylate, 3-(glycidoxypropyl)trimethoxy silane, 2-allyloxy ethanol, docosyl acrylate, N-t-butylacrylamide, N-methylolacrylamide, epichlorohydrin-dimethylamine, caprolactam, and the like.

Representative anionic monomers suitable for use in the polymer additive include one or more of: acrylic acid, and its salts, including, but not limited to sodium acrylate, and ammonium acrylate, methacrylic acid, and its salts, including, but not limited to sodium methacrylate, and ammonium methacrylate, 2-acrylamido-2-methylpropanesulfonic acid (AMPS), the sodium salt of AMPS, sodium vinyl sulfonate, styrene sulfonate, maleic anhydride, maleic acid, and it's salts, including, but not limited to the sodium salt, and ammonium salt, sulfonate itaconate, sulfopropyl acrylate or methacrylate, or other water-soluble forms of these or other polymerisable carboxylic or sulphonic acids and crotonic acid and salts thereof. Sulfomethylated acrylamide, allylsulfonate, sodium vinyl sulfonate, itaconic acid, acrylamidomethyl butanoic acid, fumaric acid, vinylphosphonic acid, vinylsulfonic acid, vinylsulfonic acid sodium salt, allylphosphonic acid, 3-(allyloxy)-2-hydroxypropane sulfonate, sulfomethyalted acryamide, phosphono-methylated acrylamide, ethylene oxide, propylene oxide and the like.

Representative cationic monomers suitable for use in the polymer additive include one or more of: dialkylaminoalkyl acrylates and methacrylates and their quaternary or acid salts, including, but not limited to, dimethylaminoethyl acrylate methyl chloride quaternary salt, dimethylaminoethyl acrylate methyl sulfate quaternary salt, dimethylaminoethyl acrylate benzyl chloride quaternary salt, dimethylaminoethyl acrylate sulfuric acid salt, dimethylaminoethyl acrylate hydrochloric acid salt, dimethylaminoethyl methacrylate methyl chloride quaternary salt, dimethylaminoethyl methacrylate methyl sulfate quaternary salt, dimethylaminoethyl methacrylate benzyl chloride quaternary salt, dimethylaminoethyl methacrylate sulfuric acid salt, dimethylaminoethyl methacrylate hydrochloric acid salt, dialkylaminoalkylacrylamides or methacrylamides and their quaternary or acid salts such as acrylamidopropyltrimethylammonium chloride, dimethylaminopropyl acrylamide methyl sulfate quaternary salt, dimethylaminopropylacrylamide sulfuric acid salt, dimethylaminopropyl acrylamide hydrochloric acid salt, methacrylamide propyltrimethylammonium chloride, dimethylaminopropyl methacrylamide methyl sulfate quaternary salt, dimethylaminopropyl methacrylamide sulfuric acid salt, dimethylaminopropyl methacrylamide hydrochloric acid salt, diethylaminoethylacrylate, diethylaminoethylmethacrylate, diallyldiethylammonium chloride, diallyldimethyl ammonium chloride and 2,3-epoxypropyltrimethylainmonium chloride. Alkyl groups are generally C1-4 alkyl.

EXAMPLES

The foregoing may be better understood by reference to the following examples, which are presented for purposes of illustration and are not intended to limit the scope of the invention. In particular the examples demonstrate representative examples of principles innate to the invention and these principles are not strictly limited to the specific condition recited in these examples. As a result it should be understood that the invention encompasses various changes and modifications to the examples described herein and such changes and modifications can be made without departing from the spirit and scope of the invention and without diminishing its intended advantages. It is therefore intended that such changes and modifications be covered by the appended claims.

Example #1

A number of NCC-polymers were made according to a growing-from approach. A 4-neck, 1.5 L reactor was fitted with a) an overhead mechanical stirrer connected to a metal shaft and a conical stirrer, b) a nitrogen inlet and sparge tube, c) a claisen adapter fitted with a reflux condenser d) a temperature probe (RTD) inserted through Teflon connector and temperature was controlled by Athena. To the reactor was added a 562.5 mL of pH adjusted NCC ($1.14\times10^{-6}$ mol, 2.81 g, pH=2) dispersion and purged with $N_2$ for 30 min and then ceric ammonium nitrate (CAN, $1.12\times10^{-3}$ mol, 6.17 g) was allowed to react with NCC backbone for 15 min under $N_2$ at R.T. The reactor was set to 70° C. and then 52.41 g of acrylamide ($7.38\times10^{-1}$ mol), 17.08 g of acrylic acid ($3.16\times10^{-1}$ mol) and water (84.67 g) were added to reactor at 42° C. Reaction mixture was heated to 70° C. and was maintained at 70° C. for 6 h. At 45 min 160 ppm of sodium hypo phosphite was added. Reaction was monitored by HNMR analysis of reaction aliquots (quenched with 500-1000 ppm of hydroquinone) and reached 92% conversion in 6 h (Table 2). Post modification was carried out using potassium persulfate (KPS, 500 μmol) and sodium metabisulfite (SBS, 3500 μmol) to burn out residual monomers. The nitrogen sparge was maintained throughout the reaction. The final pH of polymer was adjusted to 3.5 with NaOH and submitted to application testing. All samples were submitted for residual acrylamide and acrylic acid analyses. Results are shown in Table 1.

TABLE 1

Anionic NCC-Polymers Sample data.

| Sample Id | Sample Description | Mol % AA | Mol % AM | pH | Residuals AA | Residuals AM |
|---|---|---|---|---|---|---|
| 6653-145 | NCC/AA/AM | 30 | 70 | 3.5 | 746 | 63 |
| 6653-157 | NCC/AA/AM | 70 | 30 | 3.5 | 566 | 352 |
| 6653-159 | NCC/AA/AM | 50 | 50 | 3.7 | 524 | 112 |
| 6653-179 | NCC/AA | 100 | — | 1.58 | 340 | — |

Note:

Total active solids: 8% for all polyelectrolytes

The NCC-polymers were then added to a paper furnish. The alkaline furnish had a pH of 8.1 and was composed of 80% by weight cellulosic fibers and 20% precipitate calcium carbonate diluted to a consistency of 0.5% by weight. The fiber consisted of ⅔ bleached hardwood kraft and ⅓ bleached softwood kraft. The retention performance of NCC and polymer-grafted NCC was evaluated using the Britt Jar test method. The testing sequence is shown below.

TABLE 2

| | |
|---|---|
| t = 0 sec | Start |
| t = 5 sec | Starch @ 10.0 #/t |
| t = 20 sec | Flocculant |
| t = 55 sec | NCC-polymer or comparison additives |
| t = 60 sec | Drain |
| t = 90 sec | Stop |

500 ml of furnish was charged in Britt jar and mixed at 1250 rpm. Starch Solvitose N was then charged at 10 lb/ton dry weight at 5 seconds. Cationic flocculant 61067 was change at 20 seconds. Then at 55 seconds, NCC or NCC-polymer was charged. Drain started at 60 seconds and ended at 90 seconds. The drain (filtrate) was collected for turbidity measurement. The turbidity of the filtrate is inversely proportional to the furnish retention performance. The turbidity reduction % is proportional to the retention performance of the retention program. The higher the turbidity reduction %, the higher the retention of fines/or fillers. Two commercially available products, Nalco 8677Plus (a polyacrylic acid polymer) and Nalco 8699 (a silica product), were tested for retention performance as references.

TABLE 3

Turbidity reduction % of the filtrates from Britt jar test

| Material | Blank | Nalco 8677Plus | Nalco 8699 | NCC | NCC/AA | NCC/AM/AA |
|---|---|---|---|---|---|---|
| 0.00 lb/ton | 41.9 | | | | | |
| 0.125 lb/ton | | | | | 66.6 | |
| 0.25 lb/ton | | | | | 70.5 | 61.9 |
| 0.5 lb/ton | | | | 66.7 | 67.8 | 60.6 |
| 1.0 lb/ton | | 56.5 | 45.8 | 70.9 | 66.9 | 58.7 |
| 2.0 lb/ton | | | 58.1 | 81.0 | 66.2 | |

As seen from the data, at the tested dosage range of 0.5 lb./ton to 2.0 lb./ton, NCC provided additional 28.8% to 39.1% turbidity reduction in comparison to the blank example, which well-performed than the two references 8677Plus and 8699. Nalco 8677Plus at 1.0 lb./ton showed only 14.6% more turbidity reduction than the blank and Nalco 8699 at 2.0 lb./ton showed only 16.2% more turbidity reduction than the blank. NCC-polymer with acrylic acid (NCC/AA) and acrylamide/acrylic acid (NCC/AM/AA) showed 25% more turbidity reduction and 18% more turbidity reduction respectively than the blank. The results revealed that both NCC and NCC-Polymer significantly improve turbidity reduction of tested furnish, which can lead better retention efficiency and cost reduction in paper production.

Example #2

The experiments contrasted the ability of NCC and NCC-polymer to increase sheet dry strength as comparison as a conventional polyacrylamide based dry strength agent N-1044. NCC-polymer used in this example is 6653-145 listed in Table 1. The furnish contained 60% hardwood and 20% softwood and 20% precipitated calcium carbonate (PCC) as filler. 18 lb/ton cationic starch Stalok 310 was added as conventional dry strength agent, and various doses of NCC, NCC-polymer and N-1044 were added after cationic starch. 1 lb/ton N-61067 was added as retention aid. The treated furnish was used to make handsheet using Noble & Wood handsheet mold. The paper was pressed using a static press and dried by passing it once through a drum dryer at about 105° C. The resulted handsheets were allowed to equilibrate at 23° C. and 50% relative humidity for at least 12 hours before testing. Five duplicate handsheets were made for each condition and the mean values were reported.

A summary of the handsheet results was listed in the table below.

TABLE 4

| Exp No. | Dry Strength Type | Dry Strength Dose (lb/ton) | Basis Weight Mean | Basis Weight σ | Ash content Mean | Ash content σ | ZDT (kPa) Mean | ZDT (kPa) σ | ZDT (kPa) Est. at 20% AC | ZDT (kPa) increase | Tensile Index (N · m/g) Mean | Tensile Index (N · m/g) σ | Tensile Index (N · m/g) I at 20% A | Tensile Index (N · m/g) increase |
|---|---|---|---|---|---|---|---|---|---|---|---|---|---|---|
| 1 | None | 0.0 | 76.7 | 0.7 | 19.5 | 0.7 | 366.8 | 16.7 | 362.3 | 0.0% | 25.0 | 1.2 | 24.6 | 0.0% |
| 2 | None | 0.0 | 77.8 | 0.6 | 25.2 | 0.4 | 312.0 | 22.8 | 362.3 | 0.0% | 20.2 | 1.6 | 24.6 | 0.0% |
| 3 | 1044 | 2.0 | 74.9 | 0.5 | 18.5 | 0.3 | 426.0 | 20.0 | 411.5 | 13.6% | 31.5 | 1.4 | 30.2 | 22.6% |
| 4 | 1044 | 4.0 | 74.5 | 0.8 | 17.2 | 0.5 | 479.4 | 13.3 | 452.1 | 24.8% | 33.7 | 0.9 | 31.3 | 27.1% |
| 5 | NCC-polymer | 2.0 | 74.4 | 0.4 | 18.1 | 0.4 | 460.2 | 16.3 | 441.9 | 22.0% | 33.8 | 1.9 | 32.2 | 30.7% |
| 6 | NCC-polymer | 4.0 | 72.6 | 0.4 | 15.9 | 0.4 | 488.8 | 16.8 | 449.3 | 24.0% | 35.6 | 1.5 | 32.1 | 30.4% |
| 7 | NCC | 2.0 | 77.8 | 0.3 | 20.3 | 0.4 | 367.8 | 8.8 | 370.5 | 2.3% | 25.0 | 0.8 | 25.3 | 2.7% |
| 8 | NCC | 4.0 | 77.7 | 0.5 | 20.5 | 0.4 | 352.1 | 17.3 | 356.6 | −1.6% | 24.9 | 0.6 | 25.3 | 3.0% |

Addition of dry strength agents N-1044 and NCC-polymer changed filler retention and filler content into the sheet. But sheet properties were compared at fixed ash content 20% based on the relationship of strength and filler content derived from exp. 1 and 2 assuming sheet strength (ZDT and tensile index) decreases linearly with ash content. As shown in the table, NCC did not increase sheet strength significantly. On the other side, NCC-polymer increased ZDT and tensile strength over 20%. NCC-polymer was more effective than N-1044 especially at low dose 2 lb/ton.

Example #3

Laboratory experiments were conducted to measure the ability of the NCC and NCC-Polymer to increase the surface strength of paper. Base paper containing 16% ash and that has not been passed through a size press was coated using the drawdown method with solutions containing the desired chemistry. The mass of the paper before and after coating was used to determine specific chemical dose. The paper was dried by passing it once through a drum dryer at about 95° C. and allowed to equilibrate at 23° C. and 50% relative humidity for at least 12 hours before testing.

Surface strength was measured using TAPPI (Technical Association of Pulp and Paper Industries) method T476 om-01. In this measurement, the surface strength is inversely proportional to the amount of mass lost from the surface of the paper after having been systematically "rubbed" on a turn table by two abrasion wheels. The results are reported in mg of lost material per 1000 revolutions (mg/1000 revs): the lower the number the stronger the surface.

A first study compared the performance of the NCC with a copolymer of AA/AM known to increase paper surface strength. As part of the study, two blends of the NCC with the copolymer were tested. The table below shows the conditions and the results:

TABLE 5

| Condition | Starch, lb/t | AA/AM, lb/t | NCC, lb/t | Abrasion loss, mg/1000 revs |
|---|---|---|---|---|
| 1 | 20.2 | — | — | 908 |
| 2 | 28.5 | — | — | 720 |
| 3 | 32.5 | — | — | 623 |
| 4 | 24.8 | — | 1.08 | 690 |
| 5 | 24.5 | — | 2.13 | 662 |
| 6 | 22.8 | 0.99 | — | 738 |
| 7 | 21.3 | 0.93 | 0.93 | 661 |
| 8 | 21.8 | 0.95 | 1.90 | 629 |

The first three conditions span a range of starch dose within which the conditions containing the NCC, the copolymer and the blends are dosed. After accounting for the strengthening effect of starch, the abrasion loss results demonstrate that the NCC and the AA/AM copolymer have a similar level of performance. The effect is further enhanced when the additives are blended in a 50:50 and a 33:67 NCC:AA/AM ratio.

Next, a study was designed to determine whether growing an AA/AM copolymer on to the surface of the NCC improves the paper surface strength and compare its performance with that of the NCC. As part of this study, three NCC-Polymers varying in the AA/AM monomer ratio were tested. The table below shows the conditions and the results:

TABLE 6

| Condition | AA/AM monomer ratio | Starch, lb/t | NCC, lb/t | NCC-Polymer, lb/t | Abrasion loss, mg/1000 revs |
|---|---|---|---|---|---|
| 1 | — | 17.5 | — | — | 899 |
| 2 | — | 23.1 | — | — | 681 |
| 3 | — | 27.2 | — | — | 558 |
| 4 | — | 22.9 | 1.00 | — | 640 |
| 5 | 30/70 | 20.3 | — | 0.88 | 631 |
| 6 | 50/50 | 20.6 | — | 0.90 | 598 |
| 7 | 70/30 | 20.2 | — | 0.88 | 633 |

The first three conditions span a range of starch dose within which the conditions containing the NCC and NCC-Polymers are dosed. After accounting for the starch dose in each of the conditions, the abrasion loss results demonstrate that the grafting of the AA/AM copolymer on to the surface of the NCC is an improvement over the NCC. The surface strength performance is not affected, however, by the AA/AM monomer ratio in the 30/70 to 70/30 range.

Next, a study was designed to simultaneously compare surface strength performance as a function of all of the conditions (i.e., unmodified, modified with an anionic polymer of different mole ratios, and blends of the unmodified NCC with the AA/AM copolymer). The table below shows the conditions and the results,

TABLE 7

| Condition | Starch, lb/t | AA/AM, lb/t | NCC, lb/t | NCC-Polymer (30/70 AA/AM), lb/t | Abrasion loss, mg/1000 revs |
|---|---|---|---|---|---|
| 1 | 15.3 | — | — | — | 799 |
| 2 | 27.2 | — | — | — | 507 |
| 3 | 13.7 | 0.91 | — | — | 772 |
| 4 | 25.9 | 0.86 | — | — | 451 |
| 5 | 13.0 | 2.59 | — | — | 644 |
| 6 | 23.0 | 2.30 | — | — | 399 |
| 7 | 15.6 | — | 1.04 | — | 725 |
| 8 | 28.9 | — | 0.96 | — | 505 |
| 9 | 14.9 | — | 2.98 | — | 725 |
| 10 | 24.4 | — | 2.44 | — | 422 |
| 11 | 13.6 | — | — | 0.91 | 761 |
| 12 | 25.1 | — | — | 1.01 | 443 |
| 13 | 12.7 | — | — | 2.53 | 708 |
| 14 | 25.9 | — | — | 2.59 | 401 |
| 15 | 14.4 | 0.86 | 0.10 | — | 740 |
| 16 | 22.3 | 0.67 | 0.07 | — | 441 |
| 17 | 13.0 | 2.34 | 0.26 | — | 665 |
| 18 | 22.2 | 2.00 | 0.22 | — | 382 |

The first two conditions only contained starch, while the others contained about 1 or 3 lb/t of the additive. On conditions 15-18, the unmodified NCC:AAAM blends were prepared in a 10:90 mass ratio. The contributions of the multiple variables in this study were better elucidated with a regression analysis of the results. The model for the analysis resulted in a correlation coefficient of 0.80 with all variables (starch, the AA/AM copolymer, NCC, NCC-Polymer, and the blends of AA/AM copolymer and the NCC) statistically contributing to the model. From highest to lowest, the magnitude of their contribution to strengthening the paper surface is the following:

1. Blends of AA/AM copolymer and NCC
2. AA/AM copolymer
3. NCC-Polymer
4. NCC

While this invention may be embodied in many different forms, there are described in detail herein specific preferred embodiments of the invention. The present disclosure is an exemplification of the principles of the invention and is not intended to limit the invention to the particular embodiments illustrated. All patents, patent applications, scientific papers, and any other referenced materials mentioned herein are incorporated by reference in their entirety. Furthermore, the invention encompasses any possible combination of some or all of the various embodiments mentioned herein, described herein and/or incorporated herein. In addition the invention encompasses any possible combination that also specifically excludes any one or some of the various embodiments mentioned herein, described herein and/or incorporated herein.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

All ranges and parameters disclosed herein are understood to encompass any and all subranges subsumed therein, and every number between the endpoints. For example, a stated range of "1 to 10" should be considered to include any and all subranges between (and inclusive of) the minimum value of 1 and the maximum value of 10; that is, all subranges beginning with a minimum value of 1 or more, (e.g. 1 to 6.1), and ending with a maximum value of 10 or less, (e.g. 2.3 to 9.4, 3 to 8, 4 to 7), and finally to each number 1, 2, 3, 4, 5, 6, 7, 8, 9, and 10 contained within the range. All percentages, ratios and proportions herein are by weight unless otherwise specified.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A method of improving a paper substrate used in a papermaking process, the method comprising the steps of:

providing an NCC-polymer, and adding the NCC-polymer to a paper substrate in the dry end of a papermaking process, wherein the NCC-polymer is substantially distributed on the surface of the substrate with the use of a size press, and wherein the NCC-polymer is a branched polymer having a first polymer chain extending from an NCC core and at least one branch diverting away from the first polymer chain.

2. The method of claim 1 wherein the NCC-polymer comprises a polymer chain bonded to an NCC core and the polymer chain is made up of one or more monomers selected from the list consisting of:

vinyl acetate, acrylic acid, sodium acrylate, ammonium acrylate, methyl acrylate, acrylamide, acrylonitrile, N,N-dimethyl acrylamide, 2-acrylamido-2-methylpropane-1-sulfonic acid, sodium 2-acrylamido-2-methylpropane-1-sulfonate, 3-acrylamidopropyl-trimethylammonium chloride, diallyldimethylammonium chloride, 2-(dimethylamino)ethyl acrylate, 2-(acryloyloxy)-N,N,N-trimethylethanaminium chloride, N,N-dimethylaminoethyl acrylate benzyl chloride quaternary salt, 2-(acryloyloxy)-N,N,N-trimethylethanaminium methyl sulfate, 2-(dimethylamino)ethyl methacrylate, 2-(methacryloyloxy)-N,N,N-trimethylethanaminium chloride, 3-(dimethylamino)propyl methacrylamide, 2-(methacryloyloxy)-N,N,N-trimethylethanaminium methyl sulfate, methacrylic acid, methacrylic anhydride, methyl methacrylate, methacryloyloxy ethyl trimethyl ammonium chloride, 3-methacrylamidopropyl-trimethyl-ammonium chloride, hexadecyl methacrylate, octadecyl methacrylate, docosyl acrylate, n-vinyl pyrrolidone, 2-vinyl pyridine, 4-vinyl pyridine, epichlorohydrin, n-vinyl formamide, n-vinyl acetamide, 2-hydroxyethyl acrylate glycidyl methacrylate, 3-(allyloxy)-2-hydroxypropane-1-sulfonate, 2-(allyloxy)ethanol, ethylene oxide, propylene oxide, 2,3-epoxypropyltrimethylammonium chloride, (3-glycidoxypropyl)trimethoxy silane, epichlorohydrin-dimethylamine, vinyl sulfonic acid sodium salt, sodium 4-styrene sulfonate, caprolactam and any combination thereof.

3. The method of claim 1 wherein the NCC-polymer is a polymer grafted on to at least one NCC core.

4. The method of claim 1 wherein the NCC-polymer is a branched polymer having a first polymer chain extending from an NCC core and more than one branch diverting away from the first polymer chain.

5. The method of claim 1 wherein at least one branch is constructed out of a different selection of monomers than the first polymer chain, the different selection being different in monomer type, monomer ratio, or both.

6. The method of claim 1 wherein the NCC-polymer increases the dry strength of the paper substrate.

7. The method of claim 1 wherein the NCC-polymer increases the wet strength of the paper substrate.

8. The method of claim 1 wherein the NCC-polymer increases the wet web strength of the paper substrate.

* * * * *